United States Patent [19]

Nar

[11] Patent Number: 4,504,807

[45] Date of Patent: Mar. 12, 1985

[54] HIGH INRUSH CURRENT CIRCUIT BREAKER

[75] Inventor: Ramesh Nar, Hartford, Conn.

[73] Assignee: Carlingswitch, Inc., West Hartford, Conn.

[21] Appl. No.: 616,312

[22] Filed: Jun. 1, 1984

[51] Int. Cl.[3] ..... H01H 7/03

[52] U.S. Cl. ..... 335/61; 335/63; 335/239

[58] Field of Search ..... 335/59, 61, 63, 67, 335/236, 239, 240, 258, 259, 260

[56] References Cited

U.S. PATENT DOCUMENTS 3,740,650 6/1973 Grenier et al. ..... 335/239
3,777,294 12/1973 Grenier ..... 335/239 X

FOREIGN PATENT DOCUMENTS 2119901 12/1971 Fed. Rep. of Germany ..... 335/239
2656877 7/1977 Fed. Rep. of Germany ..... 335/239
9099 4/1967 Japan ..... 335/239

*Primary Examiner*—George Harris
*Attorney, Agent, or Firm*—McCormick, Paulding & Huber

[57] ABSTRACT

A magnetic circuit breaker has a U-shaped magnetizable plate between the solenoid coil and the plastic spool flange located below the pole piece that is engaged by the armature to trip the breaker. This U-shaped disc diverts some of the instantaneous flux created by an inrush current spike away from the pole piece to prevent premature or "instantaneous" tripping of the breaker until a predetermined multiple of rated current is exceeded. In the preferred embodiment this disc is provided in a slot formed in the plastic spool flange itself.

10 Claims, 4 Drawing Figures

HIGH INRUSH CURRENT CIRCUIT BREAKER

This invention relates generally to electomagnetic switching devices, and deals more particularly with a magnetic circuit breaker of the time delay type which allows predetermined transients to pass through the breaker without causing the breaker to trip.

The object of the present invention is to provide a modification in a known type of electromagnetic circuit breaker such that high inrush currents of relatively short duration can be accommodated without tripping of the breaker.

BACKGROUND OF THE INVENTION

This invention relates to electromagnetic circuit breakers in which current overload sensing is accomplished by a solenoid coil adapted to pull in a plunger when the overload current exceeds some predetermined value and thereby actuate an armature and associated electrical switch in circuit with the supply current. The plunger is spring biased outwardly of the coil and is restrained for movement in a fluid filled tube of nanmagnetizable material. The purpose of the time delay feature is to avoid tripping of the armature as a result of slight overloads in the supply current. High overload currents act to substantially instantaneously attract the armature even before the plunger moves from its "out" to its "in" position.

Although circuit breakers of the general type described above have been utilized in the trade for many years with satisfactory results, present day equipment has been adapted to withstand substantially higher momentary inrush currents than equipment of the past. Furthermore, on startup of an electrical load, relatively high inrush currents are experienced for a very brief time causing premature tripping of the armature even before the plunger has moved from its out to its in position. Therefor, the object of the present invention is to provide an economically feasible modification to a conventional electromagnetic circuit breaker so as to accommodate higher momentary inrush currents without such instantaneous tripping of the armature.

SUMMARY OF THE INVENTION

This invention resides in an electromagnetic circuit breaker comprising a generally L-shaped magnetizable frame with mutually perpendicular frame legs. A solenoid winding is provided on a plastic spool having oppositely arranged end flanges one of which is provided on one frame leg and the other of which is integrally connected to the one flange by a central annular portion defining an internal bore adapted to receive the delay tube. The delay tube is attached to the one frame leg with the end portions of the delay tube spaced from the leg so that the delay tube is somewhat longer than the axial length of the spool. A pole piece is provided in one end of the delay tube so as to be engaged by the pivotally mounted armature conventionally provided on the frame for movement between a normal and a tripped position. The delay tube has a magnetizable plunger slidably received for movement between "out" and "in" positions inside the tube and a first magnetic circuit is defined by the pole piece, the frame, the plunger and the pivotally mounted armature. When a predetermined overload current is passed through the winding of the solenoid coil the plunger moves from its "out" toward its "in" position through the fluid filled delay tube so as to facilitate tripping of the armature as a result of attraction between it and the pole piece. In accordance with the present invention a secondary magnetic circuit is porovided that is in part coincident with the first magnetic circuit in the frame and the plunger are included in both said first and second circuits. A U-shaped magnetizable member is provided in the seconday circuit, and more particularly is located on the central portion of the plastic spool adjacent to the end flange of the spool and between said flange and the solenoid winding on the spool. The inner edge of this U-shaped magnetizable member is located a distance D from the end of the plunger which distance D is less than the distance B between the plunger and the pole piece. This geometryu facilitates shunting of the magnetic flux during high inrush current conditions so that the pole piece and armature do not themselves accommodate one hundred percent of the magnetic flux created by the high inrush current. Once the plunger has started to move from its "out" toward its "in" position, however, the distance between it and the pole piece with lessen to something less than the distance D between the plunger and the U-shaped member creating the desired tripping of the breaker if the high inrush persists for a period of time that might damage the electrical load protected by the breaker itself.

In one version of the invention this U-shaped member is inserted under the top flange of the plastic bobbin or spool on which the solenoid coil is would. In a second version this U-shaped member is provided in a radially extending slot or recess defined by this top flange.

DETAILED DESCRIPTION OF FIGS. 1 AND 2

Figure 1:
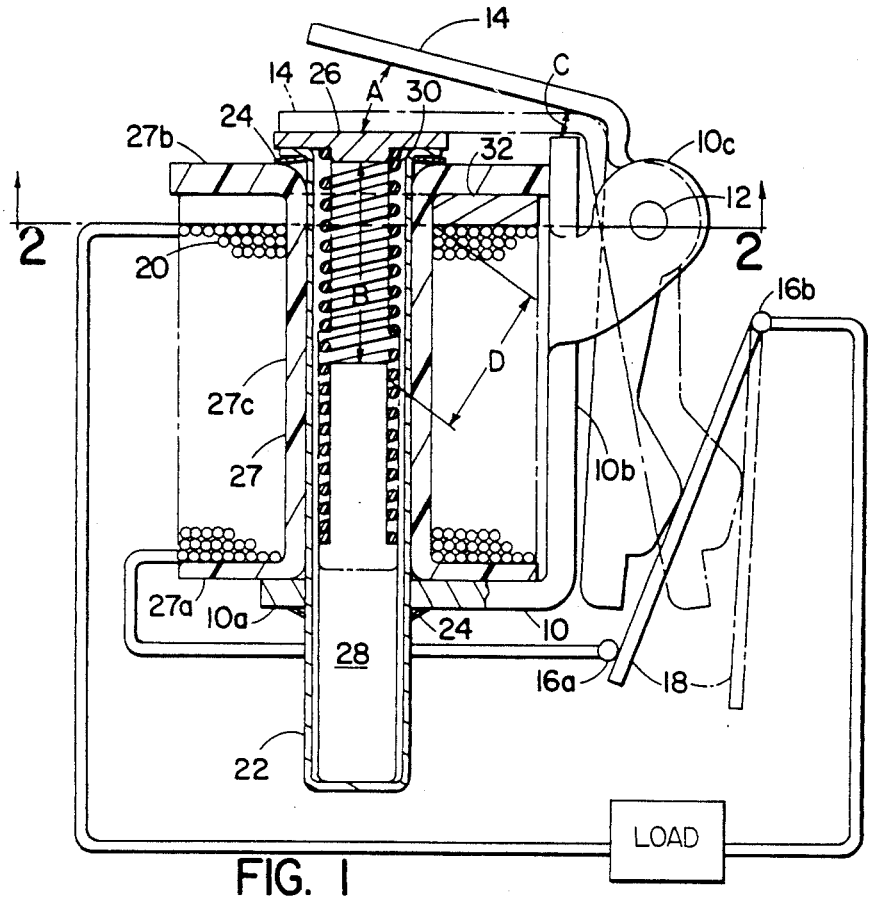
FIG. 1 is a vertical sectional view through the relevant portion of an otherwise conventional circuit breaker so modified as to provide the desired capability for accommodating high inrush currents of relatively short duration.

Turning now to the drawing in greater detail, FIG. 1 illustrates a magnetic circuit breaker of the type adapted to be equipped with an improvement of the present invention, and the conventional elements of the breaker will be described to the extent necessary for an understanding of the present invention.

The breaker of FIG. 1 includes a magnetizable frame 10 of generally L-shape having a horizontally extending leg **10*a* and vertically extending leg 10*b*. Pivot defingin ears 10*c* of frame 10 are adapted to receive a pin 12 on which the generally L-shaped armature member 14 is provided in a conventional fashion to create the necessary mechanical motion to open the electrical contacts 16*a*/16*b*. A movable contact arm 18 is shown very schematically in association with these contacts 16*a*/16*b* and for present purposes it need only be noted that opening of these electrical contacts is achieved as a result of movement of armature 14 from the solid line to the broken line position shown in FIG. 1. A load is also shown schematically in FIG. 1 and the electrical circuit for energizing this load is protected by the breaker as a result of current to the load being passed through a solenoid winding or coil 20** to be described.

A non-magnetizable delay tube 22 is mounted in the leg 10*a* of the frame 10 by suitable means, and preferably by annular fastener means 24 adapted to anchor the delay tube 20 against downward movement from the position shown. A non-magnetizable thermoplastic spool 27 is provided around the delay tube 22 and serves to provide an anchor for a second annular fastener 24 provided adjacent the upper end of the delay tube 22. A pole piece 26 is conventionally provided in the upper end of the delay tube 22 and the delay tube is preferably filled with a fluid so as to the delay movement of the plunger 28 from the solid line position shown to the broken line position indicated. A gap B is provided between the inside of the pole piece 26 and the top of the plunger 28 which gap B is, conventionally, made equal to or slightly less than approximately one-half the overall axial length of the plastic spool. The present invention does not depart significantly from this geometry.

Still with reference to the conventionally configured circuit breaker environment of the present invention, a return spring 30 is provided in the delay tube 22 to urge the plunger 28 from the broken line position toward the solid line position shown. The armature 14 is also biased by a spring (not shown) so as to urge the armature 14 from the broken to the solid line position shown in FIG. 1. A gap A is provided between the armature 14 and the pole piece 26 when the armature is in its magnetically open condition. A smaller gap C is provided between an intermediate portion of the armature and the upper end of the vertical leg 10*b* of the frame when the armature is in its open condition. Finally, a small gap is necessarily created between the plunger 28 and the hole in which the delay tube 22 is mounted in the horizontally extending leg 10*a* of the frame. This gap is mentioned here only in passing because it is a necessary result dictated by the design configuration of the circuit breaker shown and is present in both conventional breakers and the improved breaker of FIG. 1.

Turning now to a more detailed description of the improvement adopted by Applicant to achieve the advantages mentioned above, a secondary magnetic circuit is provided that is in part coincident with the primary of first magnetic circuit normally relied upon to trip armature 14 from the open condition shown to the closed position indicated in broken lines in FIG. 1. The primary magnetic circuit is created as a result of current in the coil 20. When an overload condition in the conductors to the load occurs the magnetic field created will start to move plunger 28 from the solid line position shown to a broken line position wherein the plunger and pole piece close the gap B described above. Thus, the pole piece 26 will have an opposite magnetic charge relative to the armature 14 tending to pull armature 14 from the solid line to the broken line position shown. Frame 10 completes the primary electromagnetic path defined by the plunger 28 the pole piece 26, the armature 14 and the frame legs 10*b* and 10*a* for this purpose.

Figure 2:
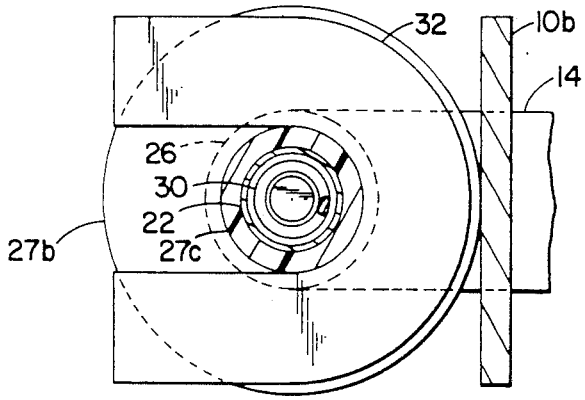
FIG. 2 is a horizontal section taken generally on the line 2—2 of FIG. 1.

When high inrush currents of short duration are encountered a situation that could cause premature tripping of armature 14, and that has been encountered prior to appreciable movement of plunger 28, a secondary magnetic circuit is created through the U-shaped plate member 32. This secondary magnetic circuit is achieved by providing dimension D of somewhat shorter length then the gap B referred to previously. Thus, the frame legs 10*a* and 10*b* together with the plunger 28 form a secondary magnetic circuit coincident at least in part with the first magnetic circuit but so configured as to avoid creating a magnetic charge on the pole piece 26 and thereby discouraging premature movement of the armature 14 toward said pole piece. In order to provide this secondary magnetic circuit for achieving the results sought here for high inrush current accommodation the otherwise conventional breaker has been fitted a magnetizable member 32 of generally U-shape configuration as best shown in FIG. 2, which member is located between the upper flange 27*b* of the spool 27 and the top of solenoid winding or coil 20. As so configured the member 32 provides a shunt path for at least a portion of the magnetic field in the magnetic circuit referred to previously. This shunt, or secondary flux path does not include the pole piece itself.

The plastic spool 27 is formed in one piece with a central bore for receiving and for mounting the delay tube 22 as described above. This spool 27 is of otherwise conventional configuration and need not be altered from that presently used in a conventional breaker in order to achieve the advantages of the present invention. Prior to assembly, however, the U-shaped plate member 32 is inserted onto the upper end of the spool and more particularly below the upper flange 27*b* so that the solenoid coil winding can be provided between plate member 32 and the lower spool flange 27*a*. U-shaped plate member 32 is of magnetizable material such as steel, and has generally parallel legs spaced apart a sufficient distance to accommodate the central portion 27*c* of the plastic spool 27. The member 32 is held in assembled relationship between this central portion 27*c* of spool 27 and the vertical leg 10*b* of the frame. As so constructed and arranged the U-shaped plate member 32 provides a very efficient path for the flux during at least initial movement of the plunger 28 so as to create the desired shorting or shunting of the magnetic flux to induce said flux to follow the secondary magnetic circuit described above. Where the winding 20 is formed of uninsulated or coated cooper wire plate member 32 is preferably insulated from coil by a vinyl coating on the plate 32 itself, or by providing a thin insulator (not shown) of the same general contour as that of the plate member 32 between it and the coil 20.

DETAILED DESCRIPTION OF FIGS. 3 AND 4

Figure 3:
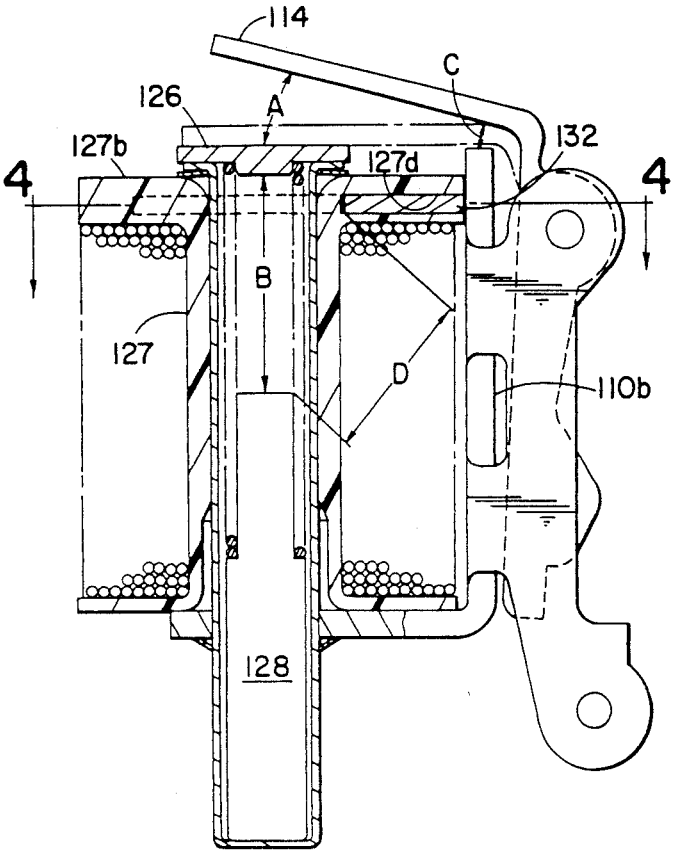
FIG. 3 is a view similar to that of FIG. 1 and illustrating an alternative version of my invention.
Figure 4:
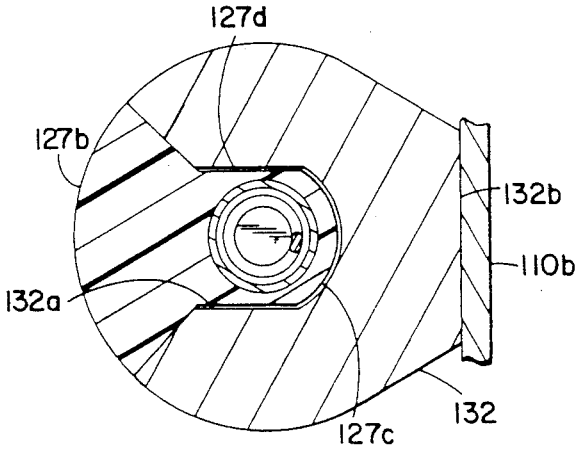
FIG. 4 is a horizontal view taken on the line 4—4 of FIG. 3.

In FIG. 3 the plastic bobbin or spool 127 is generally similar to the spool 27 described previously, except that the top flange 127*b* is somewhat thicker in the axial direction than flange 27*b*, and in that a radially open slot 127*d* (of the shape shown in FIG. 4) is provided in this flange 127*b* to receive a U-shaped flux diverter plate or member 132.

The member 132 is similar to member 32 in that it has legs defining a slot 132*a*, and the inner edge of this slot abuts a wall 127*c* that is coextensive with the central portion of the spool (as shown at 27*c* in FIG. 2).

This flux diverting member 132 also has an outer edge 132*b* that is located adjacent upright frame leg 110*b* and thereby magnetically couples these members.

The member 132 is located with its inner edge spaced from the upper end of plunger 128 a distance D, and the plunger 128 is spaced below pole piece 126 a distance B which is greater than D by a least the gap C between frame leg 110*b* and armature 114. Gap A between armature 114 and pole piece 126 is identical to that described above, as is gap C. In fact the two versions of this invention are functionally equivalent to one another. The differences between them are related to the means for retaining the flux diverting disc or plate member 32/132 in the position specified herein.

Other advantages ensue from so locating a disc member of this type in a circuit breaker of the magnetic type as described herein. For example, the thickness of this plate 132 can be varied slightly to achieve a predetermined inrush current capability without tripping the breaker contacts (e.g. pulling armature 114 down onto pole piece 126 prior to full travel for plunger 128). The following table represents, comparatively, the results achieved in a standard breaker equipped with a flux diverter disc member of the type described herein.

| duration of current | / | percent of rated current |
|---|---|---|
| C/B rated current without diverter disc | | |
| 100 sec | | 100–125% |
| .010 sec | | 1000–1250% |
| C/B rated current with diverter disc (.02" thick) | | |
| 100 sec | | 100–125% |
| .010 sec | | 3000–3500% |
| C/B rated current with diverter disc (.015" thick) | | |
| 100 sec | | 100–125% |
| .010 sec | | 1500–1750% |

As suggested in the above table, the diverter disc member 32/132 thickness in conjunction with its particular orientation, relative to the plunger, the pole and the frame, provides a convenient configuration for achieving a desired multiple of normal rated current at which the breaker will trip. The thickness of the diverter disc member 32/132 provides a direct relationship with the peak inrush current at which the breaker will trip "instantaneously" (e.g. without the usual delay due to the time required for the plunger to move from its "out" to its "in" position). This relationship between inrush current for "instantaneous" tripping and diverter disc thickness can be expressed mathematically. If we let t=thickness of the plate in inches, and N=the multiple by which normal rated current I must be multiplied to achieve a predetermined inrush current capability (NI), then we have the following empirically derived relationship: $t \geqq 1000$ N. In other words, the thickness (t) of the disc or plate member in thousandths of an inch is equal to or more than the multiple (N) by which normal rated current is increased for a high inrush current "instantaneous" trip condition. I have found that for best results a thickness of disc 132 should be kept in the range between 0.015 and 0.040. This thickness range provides a multiple N of approximately 15–30 (that is a response to instantaneous tripping of the breaker in the range of 15–30 times rated current).

I claim

1. An electromagnetic device comprising an L-shaped magnetizable frame with one and another frame leg oriented perpendicularly with respect to one another, a non-magnetizable spool having oppositely arranged top and bottom end flanges, said bottom end flange provided on said one frame leg, and said spool having an integrally formed axially extending central portion oriented parallel said another frame leg, an armature pivotally mounted to said frame for movement between a normal open position and a tripped position wherein said armature is oriented parallel said one frame leg and with a poriton of said armature lying adjacent the end of said another frame leg, biasing means to urge said armature toward its normal position, a non-magnetizable tube having a first end and a second end with an intermediate portion of said tube mounted in an opening in said one frame leg, said tube provided coaxially inside a bore of said spool so that said second end of said tube is provided adjacent top end flange of said spool, a pole piece of magnetizable material fitted in the second end of said tube and adapted to be engaged by said armature in the latters tripped position, a magnetizable plunger slidably received in said tube for movement between out and in limit positions inside said tube and cooperating with said pole piece and said frame together with said plunger to provide a first magnetic circuit, and biasing means inside said tube to urge said plunger toward its out position, solenoid winding means provided on said spool central portion and adapted to cause a predetermined magnetic flux in said first magnetic circuit so that said armature is biased toward its trip position and said plunger is biased toward its in position, a U-shaped magnetizable member defining a secondary magnetic circuit that is in part coincident with said first circuit in that the frame and the plunger are included in said first and second circuits, said U-shaped member being received on said spool such that the legs of said U are outside said central spool portion, said U-shaped member provided proximate said top spool flange and proximate said solenoid winding means, said U-shaped member having legs defining a slot substantially equal to that of said spool central portion.

2. The combination of claim 1 wherein said armature in the open position cooperates with said pole piece to define a working gap A, said plunger in its out position cooperating with said pole piece to define a gap B located within said spool bore, and said U-shaped member having an inside edge spaced from said plunger in the out position to define a gap D of shorter dimension than the gap B.

3. The combination of claim 2 wherein said armature portion that is adjacent the end of said another frame leg in the armatures tripped position does cooperate with said another frame leg in the normal open position to define a gap C which is on the order to magnitude of the difference between gap B and gap D.

4. The combination of claim 3 wherein said U-shaped member has an insulative layer between it and the said solenoid winding means.

5. The combination of claim 1 wherein said U-shaped member has an outside edge provided adjacent said another frame leg to achieve close magnetic coupling therebetween.

6. The combination of claim 1 wherein said U-shaped member comprises a flat disc having a thickness in the range between 0.015" and 0.040".

7. The combination of claim 1 wherein said U-shaped member comprises a flat disc received in a complementary shaped slot in said top end spool flange.

8. The combination of claim 7 wherein said U-shaped member has a thickness in the range between 0.015" and 0.040".

9. The combination of claim 1 wherein said U-shaped member comprises a flat disc having a thickness t (in inches) determined by the desired multiple N (by which rated current is to be increased for "instantaneous" tripping of the breaker) according to the approximate relationship $t = \geqq 1000$ N.

10. The combination of claim 9 wherein said U-shaped member has a thickness in the range between 0.015 inches and 0.040 inches.

* * * * *